US006739276B1

(12) United States Patent
Rard

(10) Patent No.: US 6,739,276 B1
(45) Date of Patent: May 25, 2004

(54) REPLACEABLE, REFLECTING KAYAK RUDDER SYSTEM WITH PEDAL AND TRIM ADJUSTING FEATURES

(75) Inventor: Roy Rard, Mount Vernon, WA (US)

(73) Assignee: Cascade Designs, Inc., Seattle, WA (US)

( * ) Notice: Subject to any disclaimer, the term of this patent is extended or adjusted under 35 U.S.C. 154(b) by 14 days.

(21) Appl. No.: 09/634,692

(22) Filed: Aug. 8, 2000

Related U.S. Application Data

(60) Provisional application No. 60/148,019, filed on Aug. 10, 1999, and provisional application No. 60/147,961, filed on Aug. 9, 1999.

(51) Int. Cl.[7] ..... B63D 35/71

(52) U.S. Cl. ..... 114/347; 114/162; 114/165; 114/144 R

(58) Field of Search ..... 114/347, 363, 114/162, 165, 144 R, 218, 153; 24/136 K

(56) References Cited

U.S. PATENT DOCUMENTS

| | | | | |
|---|---|---|---|---|
| 2,627,833 A | * | 2/1953 | Schroeder | 114/160 |
| 3,575,124 A | | 4/1971 | Alter | |
| 4,046,093 A | | 9/1977 | Prindle et al. | |
| 4,231,309 A | * | 11/1980 | Pelletier | 114/162 |
| 4,286,536 A | | 9/1981 | Alter | |
| 4,319,538 A | | 3/1982 | Macfarlane | |
| 4,711,192 A | | 12/1987 | Kooy | |
| 4,809,408 A | * | 3/1989 | Abrahamson | 24/136 K |
| 5,447,113 A | | 9/1995 | Chernin | |
| 6,612,252 B2 | * | 9/2003 | King et al. | 114/153 |

FOREIGN PATENT DOCUMENTS

| | | | | |
|---|---|---|---|---|
| DE | 33 16 636 A | * | 11/1984 | 114/162 |
| FR | 2 613 318 | * | 10/1988 | 114/144 R |

* cited by examiner

*Primary Examiner*—Sherman Basinger
(74) *Attorney, Agent, or Firm*—Graybeal Jackson Haley LLP

(57) ABSTRACT

An improved rudder system and pedal system for use in a watercraft such as a kayak. The rudder assembly includes a rudder housing having a push rod operably linked to a rudder blade positioned in the housing. A rudder control cord passes through a fairlead located at the top of the push rod and terminates at the trailing edge of the rudder blade. Upon tensioning of the rudder cord, the push rod acts against a notch in the leading edge of the rudder blade, which causes rotation of the rudder blade in addition to the rotational force on the trailing edge of the rudder blade due to movement of the control cord. A feature of the rudder assembly is the incorporation of a spring element in the rudder blade that provides an extension bias to the rudder blade, and user selectable pre-loading thereof for varying the rotational bias. The pedal system includes a toe control pivotally attached to a foot brace that is slidingly located in a track. A rudder cable arrangement is deflected by rotation of the toe control along the length of the track, thereby permitting actuation of the rudder system independent of the location in the track of the pedal system. A feature of the pedal system is the incorporation of a lockable positioning rod connected to the foot brace at one end and extending past the aft end of the track so that a user can remotely position the foot brace and retain its position. Another feature is the use of a trim control assembly to vary the length of cable between the foot brace and a mechanical ground, thereby permitting the user to remotely select the rudder blade trim, without having to modify the position of the control pedals.

26 Claims, 7 Drawing Sheets

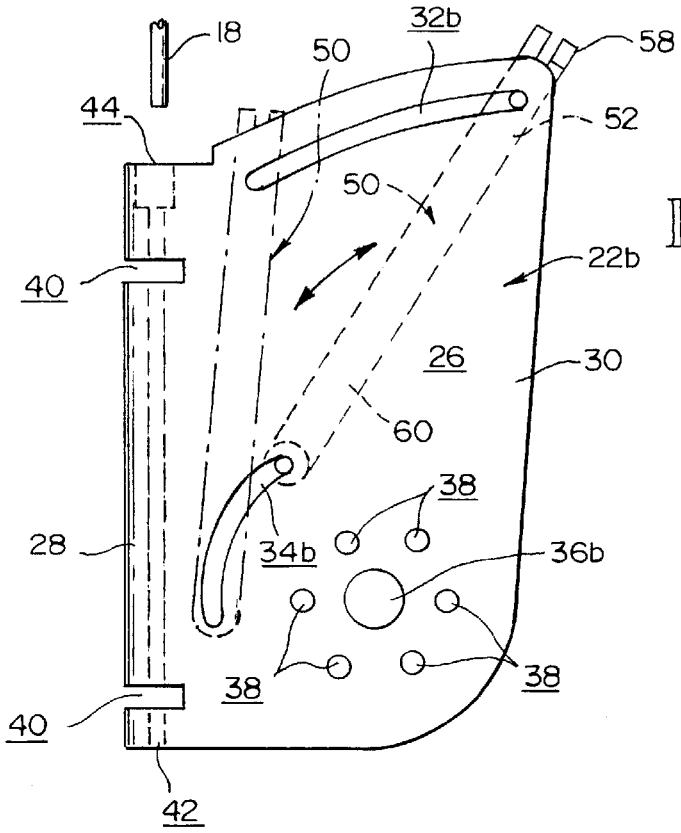
FIG. 4
FIG. 5
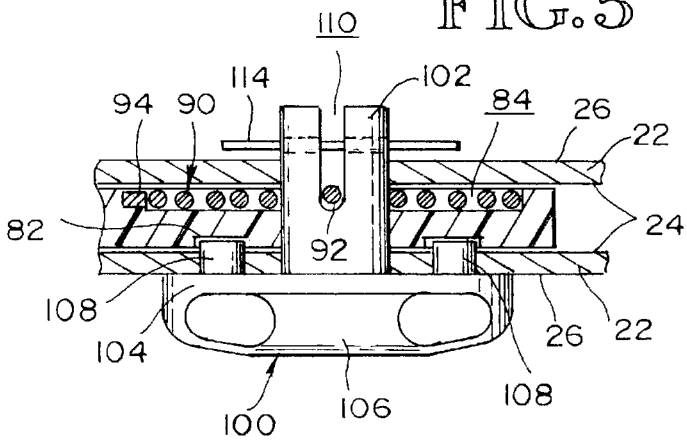

228
262
238
282
284
280
286
290
294
292
298
300
302
302a
304

282
304
306
308
302a
300

REPLACEABLE, REFLECTING KAYAK RUDDER SYSTEM WITH PEDAL AND TRIM ADJUSTING FEATURES

This application incorporates the disclosure of U.S. provisional patent application Nos. 60/147,961, filed Aug. 9, 1999 and 60/148,019, filed Aug. 10, 1999, herein by reference.

FIELD OF THE INVENTION

The present invention relates to rudder and steering systems for kayaks, and more particularly to kayaks having rudder systems that include a field replaceable rudder blade that may be remotely and easily raised or lowered during use, and remote rudder adjustment and trim structures associated with an improved pedal system.

BACKGROUND OF THE INVENTION

Stern mounted rudder assemblies are commonly used on kayaks. In some assemblies, the rudder blade is pivotally connected to a rigid mount attached to the stern of the kayak. The mount and rudder blade are designed so that the rudder blade extends downward into the water at all times during use.

In some assemblies, the rudder blade is attached to a retracting mechanism that enables the user to manually "kick-up" or rotate the rudder blade rearward and upward when approaching the shore or submerged hazards. Traditionally, a control line or, cord is passed through a fairlead and terminates at the trailing portion of the rudder blade. The fairlead acts as a fulcrum point so as the line is tensioned and retracted, the blade is brought towards the fulcrum. Such assembles are disclosed in U.S. Pat. Nos. 3,575,124, 4,046,093, and 4,319,538.

Given the fixed location of the fairlead, it is often time difficult to initially retract the rudder blade, and once so moving, the velocity of the retracting blade is frequently too fast, thereby subjecting the components to excessive forces and possible breakage. A further deficiency of the prior art is that the amount of force applied to the rudder blade to keep it extended into the water is not adjustable. Quite often it is fixed or not biased.

Another problem with currently designed rudder systems is that when the rudder blade is broken, replacement is time consuming and often requires multiple hand tools since many blades are located in a rudder housing using bolt and nut combinations.

In view of the foregoing, there is a need in the field to have a rudder assembly that permits a user to remotely retract the rudder blade with minimal force, to be able to field replace a rudder blade without the necessity of tools, and to modify the extension or downward bias of the rudder blade with ease.

Other deficiencies exist in the prior art that relate to the steering aspect of a rudder system. Conventional pedal control systems rely on a "C" track in which reciprocates a pedal having a cable or strap attached to the steering bracket or tiller of the rudder system. In these systems, the pedal acts as both a foot brace and as a means to control rudder movement. When equal pressure is applied to both pedals, there is no rudder movement and the pedals become momentarily fixed in position. When unequal pressure is applied to the pedals, there is rudder movement and the pedals move in relation to the applied force.

These systems, however, are cumbersome to adjust when a kayaker attempts to use a kayak having been adjusted for the leg length of the previous user and frequently stick due to accumulation of debris in the lower portion of the track. It often requires that the straps or cables be manually adjusted, often at a location away from the kayaker's arms and without the aid of length indexes. The result is often that numerous attempts must be made, within the cramped space of the cockpit, to adjust the pedal positions so that they are symmetrical and result in a neutral rudder setting. This task becomes especially difficult and even dangerous if attempted while the kayak is afloat.

Frequently when paddling in a constant direction for a considerable distance, it is desired to counteract a cross wind or current. A kayaker can do this by positioning the rudder in a constant angle relative to the axis of the vessel. A problem with the current rudder steering systems is that no provision is available for establishing a constant rudder position without frequent user input; the kayaker must apply just the right amount of control to the rudder so as to maintain the desired deflection and thus heading.

It therefore is apparent that there is a need to have a trim adjusting means for establishing and maintaining a rudder trim position without frequent intervention or manipulation of the kayak steering assemblies.

SUMMARY OF THE INVENTION

An object of the present invention to provide a rotating rudder blade for a kayak.

Another object to provide a rudder system that enables the rudder blade to be easily rotated or retracted with minimal force from a remote location.

A further object is to provide a rudder system that enables the rudder downward or extension force to be adjusted and which enables damaged or broken rudder blades to be easily and quickly replaced without resort to tools.

Still a further object is to provide a pedal adjustment system that allows the kayaker to independently brace his or her legs and actuate the rudder system.

Yet a further object to provide a method and mechanical arrangement for establishing a desired rubber trim position without the need for frequent user adjustment, and to do so quickly and conveniently.

Another object of the invention is to provide a pedal adjustment system that permits a user to conveniently and remotely adjust the location of a pedal residing in a track.

The rudder assembly of the invention comprises a rudder housing having a first and a second side, joined together by a common leading edge. Each side has an inner surface, an outer surface, the mentioned leading edge, and a trailing edge. The two sides are generally spaced apart and parallel to each other so as to receive an upper portion of an inserted rudder blade. Each side also defines a hub hole for receiving a rudder blade shaft.

A key feature of the invention relates to the means by which an inserted rudder blade can be retracted from a downward, extended position to a trailing (horizontal) or fully upward, retracted position. Instead of relying upon a fixed fairlead or fulcrum point, the fairlead or fulcrum point acts on a portion of the rudder blade to cause the same to move relative to the rudder housing. Movement of fulcrum is moderated by two pairs of guide members formed in the sides of the rudder housing. The guide members can take the form of tracks (either a groove defined by the inner surfaces of the rudder sides or a pair of lands extending from the inner surfaces of the sides to define a surface groove) or slots extending the sectional width of the rudder housing sides.

The fulcrum is preferably a rod or other rigid member that has guide pins or similar followers located on or in the rod so that each guide pin locates in a respective pair of guide members. In a preferred embodiment, the guide members are slots and the rod has an upper pin and a lower pin, as well as a fairlead at the upper end of the rod to receive a control line or cord.

The rudder blade that may be incorporated with the aforementioned rudder housing defines a rudder shaft hole and has a notch formed in the upper leading edge of the blade. The notch receives the lower end of the rod so that when actuated by the user, compression forces presented to the rod causes movement of the rod, which translates into rotation of the blade as the rod traverses the guide members. In this manner, the control line, which terminates at the trailing edge portion of the blade, not only applies tension to the trailing edge of the blade so as to cause rotational movement of the blade, but also moves the rod, thereby causing rotational movement of the blade as it acts on the leading edge.

Another feature of the invention relates to the field replaceability of the rudder blade. In the present invention, a constant extension or downward biasing force is presented to the rudder blade. This bias is overcome by the user by applying tension to the control line. The bias is preferably accomplished by using a torsion or flat spiral spring. Such springs have an inner tang and an outer tang. The outer tang locates in a portion of the rudder blade and the inner tang engages the rudder shaft, which is rotationally fixed relative to the rudder housing. By pre-loading the spring when the, blade is in the extended, downward position, a restoring bias is created that resists rotation to the trailing position or the fully retracted position.

To avoid interference with the rudder housing by the spring, a cylindrical recess is preferably formed in one side of the rudder blade concentric with the rudder shaft hole to receive the spring. The rudder shaft is formed to engage the inner tang of the spring, and is held rotationally fixed to the rudder housing by means of a plurality of registration pins formed in a flanged hub of the shaft that engage with corresponding registration holes defined by the adjacent rudder housing side. To ensure sufficient engagement between the registration pins of the flanged hub and the registration holes, the pins preferably extend slightly beyond the holes, and avoid contact with the rudder blade due to the presence of an annular groove formed in the blade concentrically about the rudder blade shaft hole. If adjustment of the pre-load spring bias is desired, a greater number of holes are formed as compared to the number of pins, whereby the shaft can be incrementally rotated and engaged with the rudder housing.

The pedal assembly of the invention comprises a track, preferably having an open channel section, in which resides a foot brace to which is pivotally attached a toe control. By providing for separate components to act as a foot brace and toe or rudder control, user leg movement or forces intended to transmit motive forces to the kayak will not unintentionally result in rudder actuation. When rudder actuation is desired, only low effort toe actions are required; the user's mid-sole and heel remain in contact with the foot brace.

In a preferred embodiment, the toe control acts upon a cable system that is linked at one end to a rudder assembly and to a mechanical ground at a second end. Upon user actuation, the toe control causes the cable to deflect, thereby causing a corresponding tensioning and/or movement of the cable, which results in rudder movement. Because the cable preferably extends the length of the track in which the foot brace and toe control travel, constant cable deflection will occur at any point along the track upon a consistent toe control operation.

The pedal assembly includes further features such as asymmetrical pedal extension and flexion due to an upper cam portion of a foot brace cable guide, and a means for remote location of the foot brace in the track. The later feature is accomplished by linking a rigid linear member or rod at one end to the foot brace and selectively engaging the rod in a portion of the track to temporarily attach the rod to the track or other mechanical ground. Preferably, the rod has a series of lands that create grooves that engage a slot defined in an end piece attached to the track. An ancillary benefit to this configuration is that a user can index the position of the foot brace based upon the number of exposed grooves extending beyond the slot.

While it is possible to accomplish an asymmetrical trim of an attached rudder assembly by placing a length adjusting connector between the cable end and the mechanical ground, another feature of the invention is directed to a symmetrical trim assembly that permits a user to adjust a rudder trim in a single operation. By terminating both cable ends (the ends opposite from the rudder engaging ends) from a pair of pedal assemblies in a rotatable hub, a user can simultaneously take in one cable and pay out the other cable. The trim assembly preferably includes a hub having a generally common location for terminating a pair of cables, and an outer housing defining a pair of cable fairleads. By positioning the hub in the housing so that the termination points are generally away from the pair of fairleads, retraction of one attached cable results in the extension of the opposite cable.

Additional features of the invention relate to multiple mounting possibilities, e.g., pintle mounting or bracket mounting, blade design, and other aspects of the invention that will become apparent upon inspection of the several drawings and following description.

BRIEF DESCRIPTION OF THE DRAWINGS

FIG. 4 is side elevation view of the rudder housing detailing the position of an internal push rod when the rudder system is in a running position, and, in phantom, when the rudder system is in a non-running position;

FIG. 5 is a partial cross sectional plan view of the rudder in the rudder housing, detailing the interaction between the rudder blade, a torsion spring, a rudder shaft, and the rudder housing;

DETAILED DESCRIPTION OF INVENTION

Figure 1:
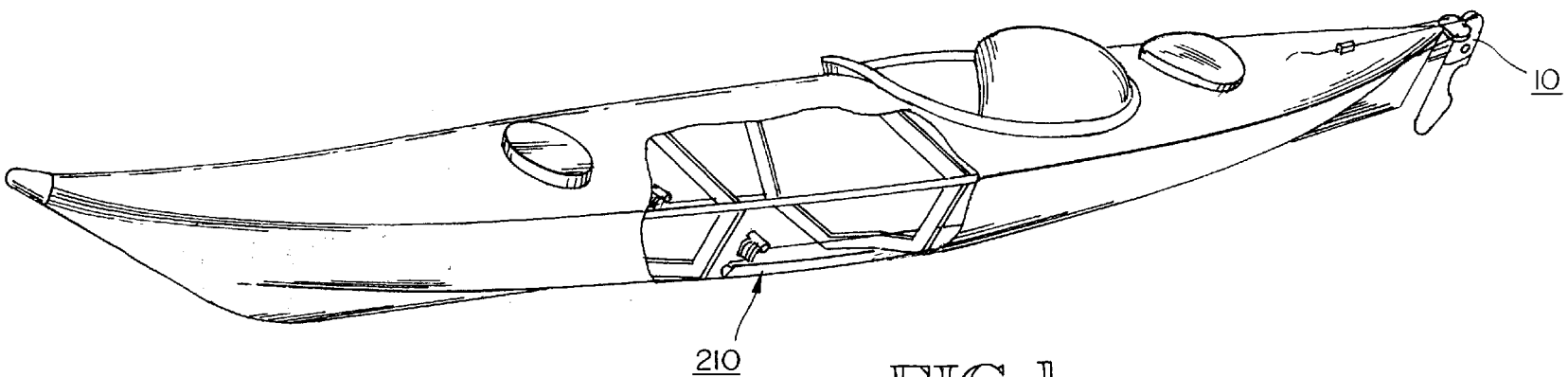
FIG. 1 is a perspective view of a kayak equipped with the invention.
Figure 3:
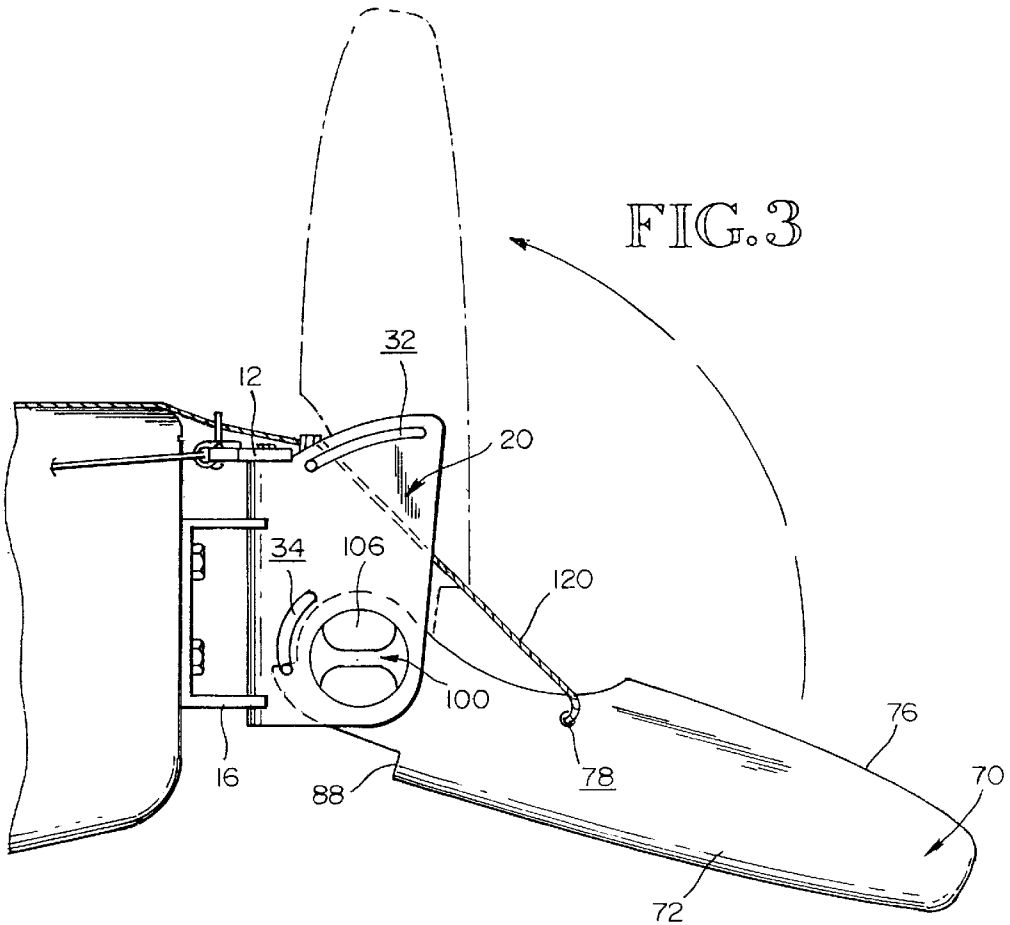
FIG. 3 is a side elevation view of the rudder system showing the rudder in a trailing position, and, in phantom, when the rudder system is in a fully retracted position.
Figure 2:
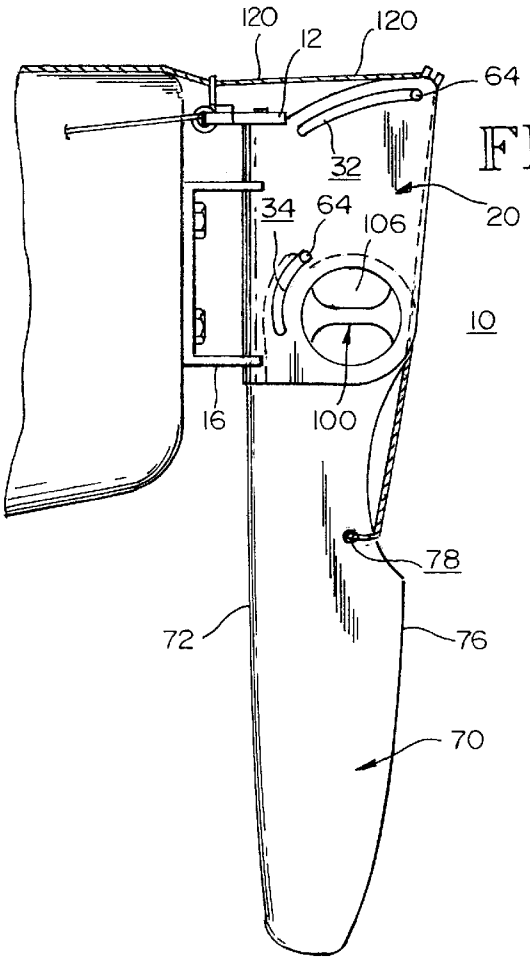
FIG. 2 is a side elevation view of the rudder system showing the rudder in a running or extended position.
Figure 6:
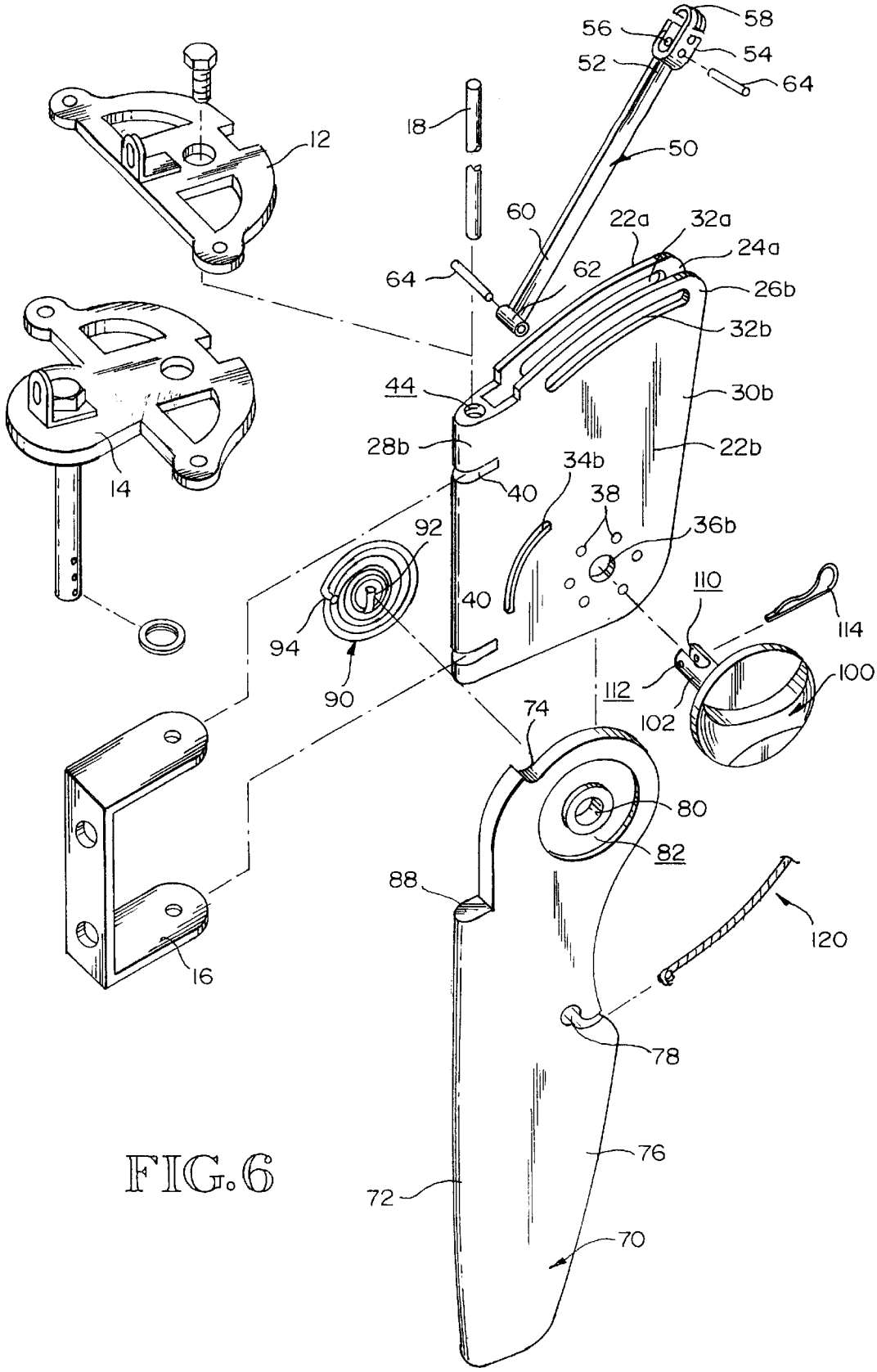
FIG. 6 is an exploded, perspective view of the rudder system and several mounting options using interchangeable tiller brackets.

Rudder Components:

Turning then to the several drawings and particularly to FIG. 6, the overall components of rudder system 10 are shown. Rudder system 10 comprises rudder housing 20, push rod 50, rudder blade 70, torsion or flat coil spring 90, rudder shaft 100, and steering bracket 12 or 14. As best shown in FIGS. 1–3, rudder system 10 is mounted to the stern of a kayak either by way of a bracket or pintle mount (see FIG. 6). Given the configuration of rudder housing 20, either mounting means may be used only by having to change the tiller bracket.

Rudder housing 20, as best illustrated in FIG. 6, comprises sides 22*a* and 22*b*, each having an inner surface 24*a* and 24*b* (obstructed), an outer surface 26*a* (obstructed) and 26*b*, leading edge portions 28*a* (obstructed) and 28*b*, and trailing edge portions 30*a* (obstructed) and 30*b*. Each side 22 defines respective upper guide slots 32, lower guide slots 34, and shaft holes 36. Side 22*b* further defines a plurality of registration holes 38. Mounting bracket receiving slots 40 are formed in the common leading edge portion 28 of both sides, and are intersected by leading edge bore 42 (see FIG. 4) so that pin 18 may be inserted there through to retain bracket 16 should a transom mounting method be desired. As an additional feature, enlarged threaded bore 44 is formed at the upper portion of bore 42 to receive a fastener, such as a bolt. In this manner, either tiller 14 with pintle or tiller 12 without pintle can be used, depending upon user preference for the mounting method.

Sides 22*a* and 22*b* are in spaced apart relation so as to receive rudder blade 70 and push rod 50. Rod 50 has upper end 52 and lower end 60. At upper end 52, yoke 54 forms a portion of fairlead 58 as well as defining holes 56 in which guide pin 64 may be inserted. Lower end 60 includes collar 62, which serves to located guide pin 64 as well as act on notch 74 formed in rudder blade 70. Rod 50 is insertable in the space defined by sides 22*a* and 22*b*, and is held captive therein by the interaction between guide pins 64 and slot pairs 32 and 34, as is best illustrated in FIG. 4.

Turning then to FIGS. 2–4, the operation and interaction of rod 50 will now be described. During operation of a kayak equipped with the invention, rudder system. 10 will be in the running or extended position as shown in FIG. 2. Upon the tensioning of control line 120, a fulcrum environment is established at fairlead 58. However, because rod 50 is permitted to translate along the path defined by slots 32 and 34, and is only retained in its initial position (see FIG. 2), by rudder 70, which is rotationally linked to rudder housing 20, rod 50 will translate towards leading edge 28 during initial tensioned movement of control line 120. As a consequence of collar 62 interacting with notch 74 (see FIG. 6), the motion of rod 50 from the running position to the trailing position, as shown in FIG. 4, causes rudder blade 70 to rotate upwardly to the trailing position as shown in FIG. 3. In this manner, both the tension force in control line 120 at retention hole 78 and the compression force in rod 50 at notch 74 cause rotation of rudder blade 70. Because of the increased mechanical advantage provided by rod 50 acting on blade 70 as compared to the mechanical advantage of control line 120 acting from fairlead 58 to retention hole 78, and because of the compounding of these forces for a common effect, less user force is necessary to rotate blade 70 about shaft 100.

When blade 70 achieves the trailing position as shown in FIG. 3, additional tensioned movement in control line 120 causes additional rotation of blade 70 until the fully retracted position (shown in phantom) is achieved. During this operation, rod 50 remains stationary and the only user induced rotational force presented to blade 70 is via control line 120 at retention hole 78.

Another significant feature of the invention concerns the field replaceability of rudder blade 70. Returning to FIG. 6, as well as FIG. 5, it can be seen, that rudder blade 70 interacts with torsion or flat coil spring 90, rudder shaft 100, and rudder housing 20 Spring 90 is located in cylindrical recess 84 formed in blade 70. Spring 90 includes inner tang 92 and outer tang 94. Inner tang 92 engages slot 110 formed in shaft 102 and outer tang 94 engages a hole formed in the inner surface of recess 84. Rudder shaft element 100 includes the previously mentioned portions, as well as flanged hub portion 104, knob portion 106 to provide a user with convenient means for rotation, registration pins 108 formed as an integral part of hub 104, and hole 112 for receiving keeper or cotter pin 114. Rudder shaft 100 is rotationally fixed relative to rudder housing 20 by means of the engagement of registration pins 108 in registration holes 38. As a consequence of these engagements, shaft 100 remains rotationally fixed relative to rudder housing 20, thereby linking rotationally movement of rudder 70 to housing 20 through spring 90. Should a user desire to bias the blade, cotter pin 114 is removed from hole 112, shaft 100 is removed so that registration pins 108 no longer engage registration holes 38, knob 106 is turned clockwise to increase spring 90 pre-loading, and shaft 100 is re-engaged with rudder housing 20.

Figure 7:
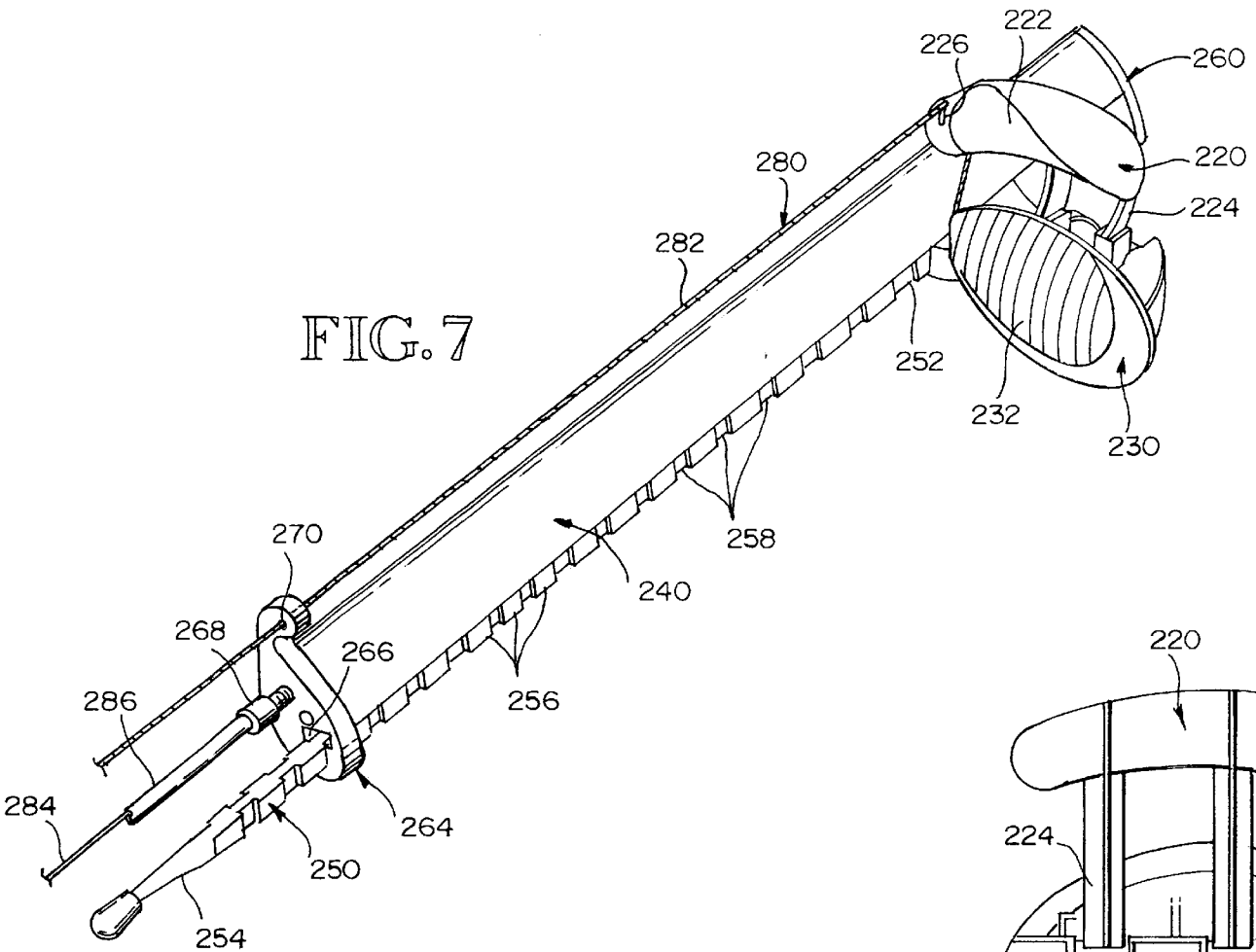
FIG. 7 is a perspective view of an adjustable pedal system wherein a sliding pedal is located in a track and operates to deflect a rudder cable.
Figure 9:
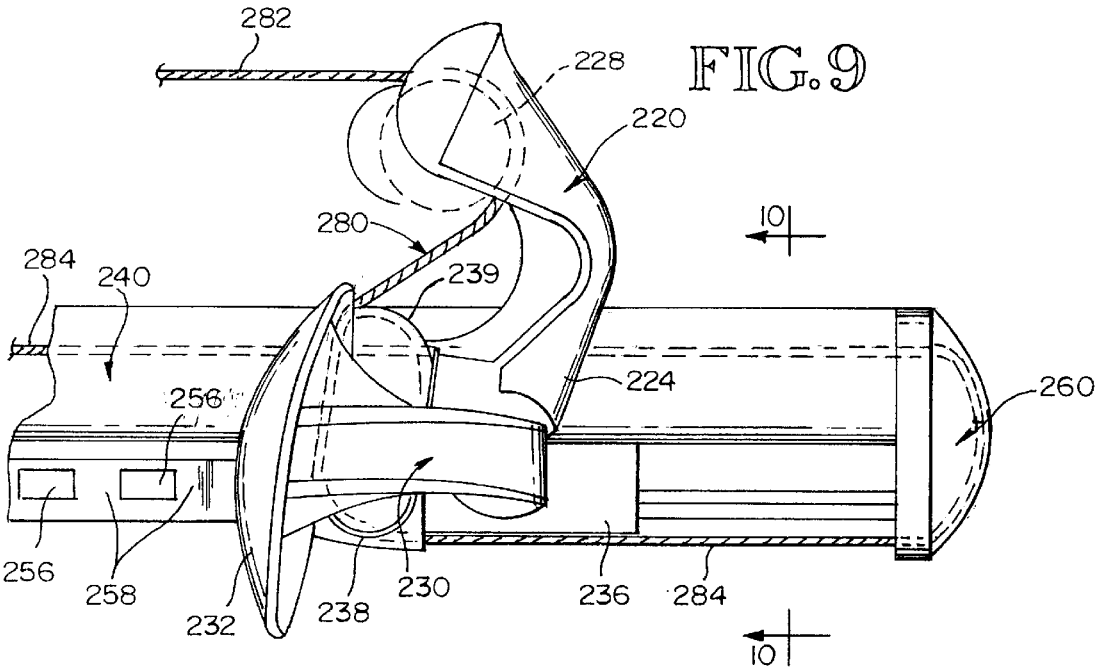
FIG. 9 is a side elevation view of the system of FIG. 7.
Figure 10:
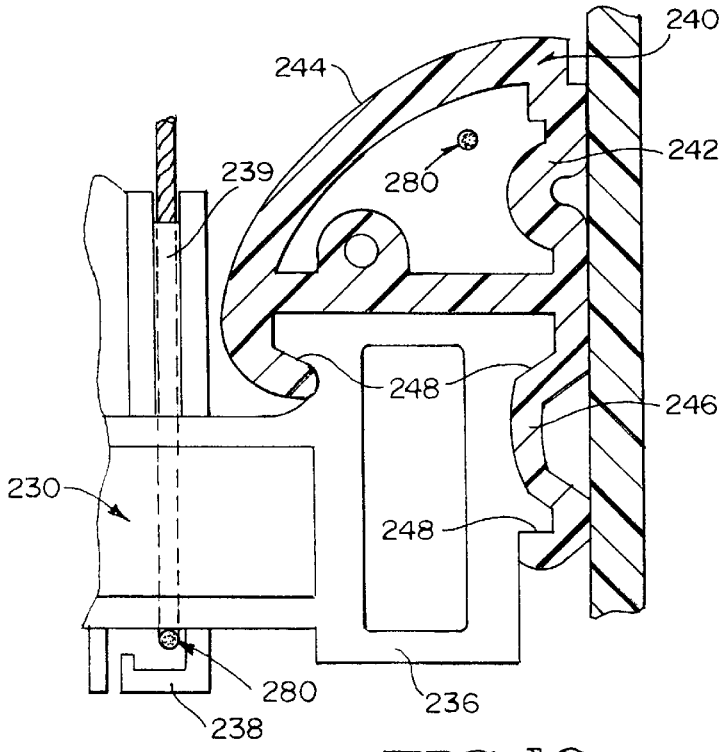
FIG. 10 is a partial cross sectional view of the system taken substantially along the line 10—10 in FIG. 9.
Figures 11, 12:
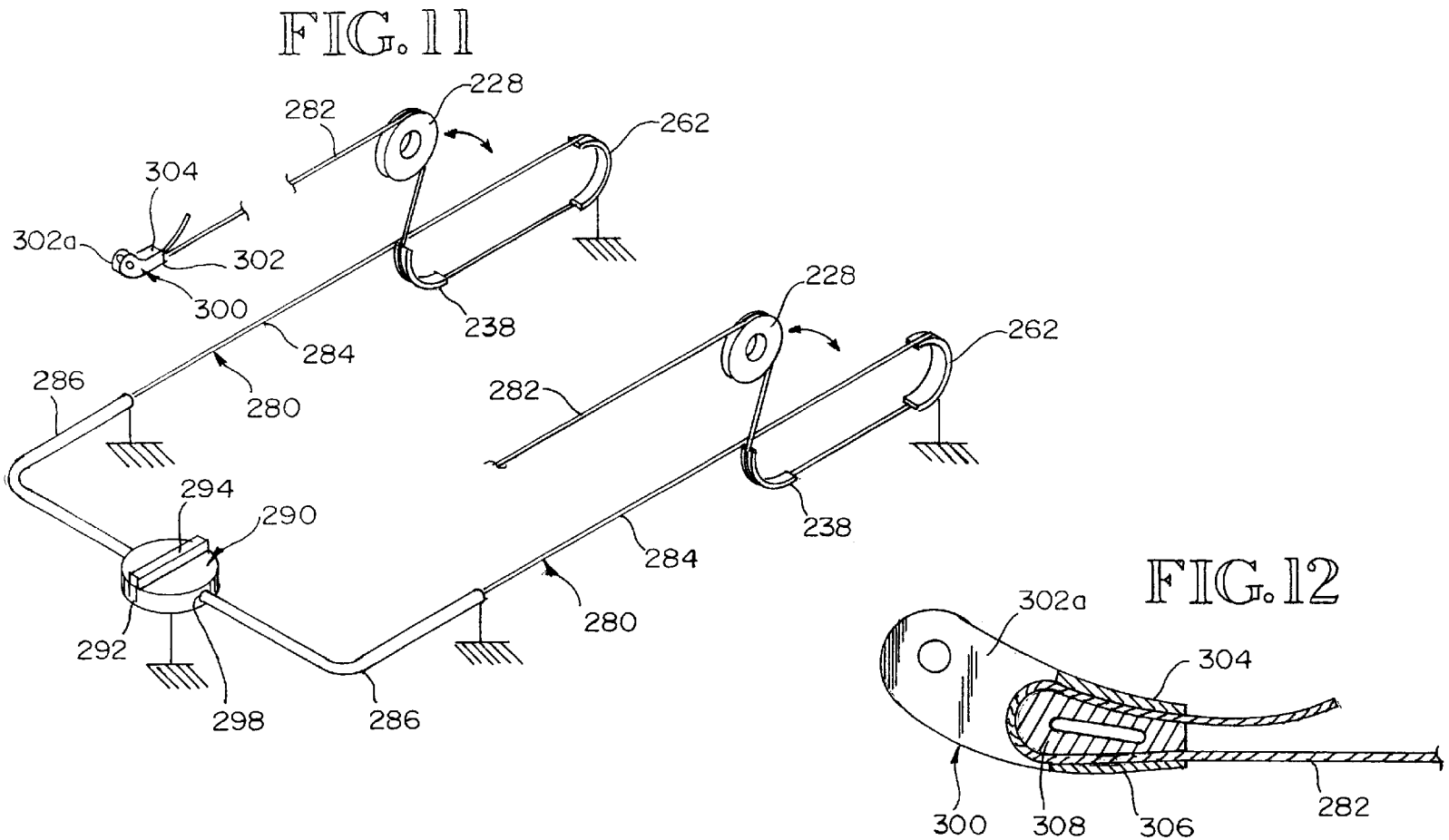
FIG. 11 is a schematic diagram showing the rudder cable routing and trim unit for providing adjustable pedals and remote trim control of the rudder system.
FIG. 12 is a cross section view of an adjustable anchor connector used in a preferred embodiment.

Steering Components:

In addition to the improvements relating to rudder system 10, the invention also concerns improvements relating to a steering system as shown in FIGS. 7–12. FIG. 7 shows in perspective adjustable pedal and foot brace assembly 210. Assembly 210 comprises toe control 220, foot brace 230, track 240, adjusting, rod 250, and cable 280. Also a component of assembly 210 and shown in FIG. 11 is trim adjuster 290. Both toe control 220 and foot brace 230 slide on track 240, meaning that cable 280 is deflected by a similar amount for any given actuation of toe control 220 regardless of their position on track 240.

Figure 8:
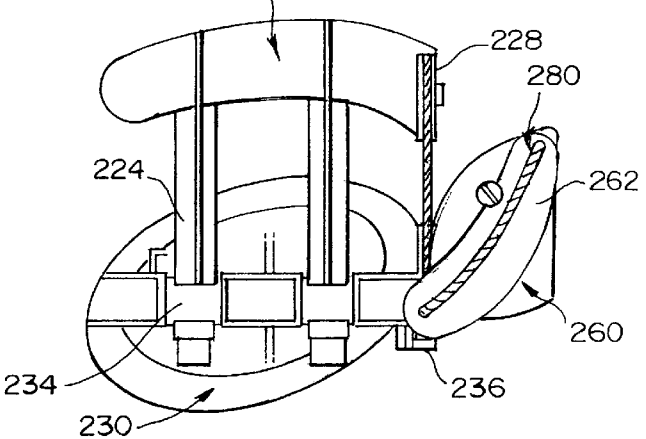
FIG. 8 is a front elevation view of the system of FIG. 7.

Referring to FIGS. 8–10, foot brace 230 comprises tread portion 232, hinge portion 234, track portion 236, and cable guide or lower fairlead 238. Track portion 236 is formed to slidingly engage track 240 and provide the required support for foot brace 230 and toe control 220, including all forces transmitted by the user to the kayak. Located outwardly from track portion is hinge portion 234. Hinge portion 234 provides a suitable configuration for linking foot brace 230 with toe control 220. Finally, tread portion 232 provides a suitable surface for accepting the lower portion of a user's foot. The function of cable guide or lower fairlead 238 and upper cam portion 239 will be described below.

Referring to FIGS. 7–10, toe control 220 comprises tread portion 222, hinge portion 224, fairlead slot 226, and turning block 228. Toe control 220 is rotationally linked to foot brace 230 by way of hinge portion 224, which are described as "C" shaped members that partially encircle hinge portion 234 of foot brace 230. An optional spring element (not shown) can be inserted between the foot brace and the toe control to pre-load toe portion 220. As with cable guide or lower fairlead 238, the function of fairlead slot 226, and turning block 228 will be described below.

Several features relating to toe control 220 as it interacts with foot brace 230 and cable 280 deserve special attention. First, hinge portion 224 has an angular profile so that during flexion (the pedal pivots aft towards tread portion 232), hinge portion 224 will not interfere prematurely with tread portion 232. Second, cable guide 238 includes upper cam portion 239 as is best shown in FIGS. 9 and 10. Upper cam portion 239 in conjunction with the angular profile of hinge portion 224 (turning block 228 is able to travel aft of cable guide or fairlead 238) causes a differential in cable travel during extension and flexion of toe control 220. Thus, an extending toe control 220 may move 1" from its neutral position and cause rudder segment 282 to travel 1", while the corresponding opposite toe control pedal, responding to a proportional 1" cable travel, undergoes flexion of only ¾" from its neutral position. This asymmetrical action and reaction is due to the progressively changing point of cable grounding on upper cam portion 239 during flexion and extension operation of toe control 220, and the geometric location of turning block 228 relative to upper cam portion 239.

It should be noted any structure that functions to guide or facilitate cable location, retention, or operation is sufficient for the purposes of the invention, and are generally referred to as guides or fairleads without-concern over the components physical structure, as will be appreciated by those persons skilled in the art.

Referring next to FIG. 10, track 240 has an upper, closed channel portion 242 and a lower, open channel portion 246. Primary structural support for track 240 is achieved by closed channel portion 242. In addition to support, this portion of track 240 has arcuate segment 244 that functions to shield open channel 246 from water and debris. Open portion has several open segments 248 that support the pedal and brace. These segments, however, are formed to minimize the collection of debris as will be appreciated by inspecting the slope of each segment.

As is best shown in FIGS. 7 and 8, at either end of track 240 are end caps. Forward end cap 260 provides cable guide 262 that functions to redirect cable 280 towards the kayak stern, while aft end cap 264 has adjusting rod slot 266, adjusting collar nut 268 and cable guide 270. Both caps are user removable and are fastened to track 240 by conventional means such as by one or more screws.

To permit a user to adjust the location of the pedal and brace, adjusting rod 250 is attached to track portion 236 of foot brace 230 at proximal end 252 and extends through adjusting rod slot 266 as is best shown in FIG. 7. Slot 266 is characterized as a "T" shape to permit free reciprocating movement of adjusting rod 250 when it is at the upper portion thereof, but is prevented from such movement when positioned in the lower portion thereof. A series of lands 256 form grooves 258 in rod 250 wherein the sectional width of rod 250 has greater spanning lands 256 than the width of slot 266 at its lower portion. A leaf spring (not shown) can be disposed between track 240 and rod 250 so as to bias rod 250 towards the lower portion of slot 266. In such a configuration, a user dislodges rod 250 from the lower portion of slot 266, translates the rod until the desired position is reached, and relocates the rod, all from the cockpit area of the kayak proximal to the user. A further benefit to using this configuration is that the location of foot brace 230 is indexed and known to the user, i.e., the number of grooves 258 exposed aft of end cap 264 is directly proportional to the location of foot brace 230.

Logically, other forms of rod retention means can be used, such as clamps, cams, pinch rollers, and other means mounted to the track or similar mechanical ground (the hull, for example) for temporarily fixing the longitudinal movement of a rod to a structure. Moreover, it is contemplated that alternative means for accomplishing this adjusting function are possible. Such alternatives include the use of a retraction arrangement (an elastic cord or spring) whereby foot brace 230 is continuously biased towards, for example, end cap 260, and a line extends aft from the foot brace to a convenient location for user manipulation (the aft end of track 240 or a cockpit location).

Turning then to FIG. 11, the functionality of the steering control can be seen. Cable 280 comprises rudder cable segments 282, trim cable segments 284, and sheathing 286. By adjusting the functional length of trim cable segment 284, the functional length of rudder cable segment 282 is proportionally adjusted, resulting in movement of an attached rudder assembly without operation of the pedal assemblies. Thus, trim adjuster 290 links each trim cable segment 284 by way of an internal drum (not shown) so that when one segment 284 is taken into adjuster 290, the other segment 284 is paid out. Trim adjuster 290 also contains friction elements (not shown) that prevent the drum from being rotated by the low hydrodynamic forces commonly acting on the rudder. However, the friction is low enough so that the adjuster may easily be moved by hand or by when the rudder is impacted by a hard object. The resulting configuration permits a user to modify the rudder position independently of cable deflection resulting from pedal operation. In this manner, a "neutral" rudder position can be selected by the user without need for pedal operation.

Lastly, and referring to FIG. 12 as well as FIG. 11, an adjustable cable anchor is shown. Anchor 300 comprises major sides 302*a* and 302*b*, web portions 304 and 306 to connect the two major sides, and wedge element 308. Wedge element 308 resides in a space defined by major sides 302*a* and 302*b*, and web portions 304 and 306. Upon tensioning of rudder cable segment 282, wedge element 308 is brought to bear against web portions 304 and 306, thereby increasing the compression between the wedge element and these portions. The resulting outcome is a self-crimping anchor assembly. For a user to adjust the location of the anchor on the cable segment, the user need only reverse the tension so as to dislodge the wedge element from its locked position, reposition the cable, and again apply tension to the cable. For added retention abilities, a cable groove can be formed in the peripheral surface of wedge element 308 as well as the interior walls of web portions 304 and 306. By using a cable groove, an inserted cable is more surrounded and less deformed when compressed by the action of the wedge element against the web portions.

What is claimed:

1. A rudder assembly for use in a watercraft comprising:

a rudder housing having a first side including an inner surface, an outer surface, a leading edge and a trailing edge, and a second side including an inner surface, an outer surface, a leading edge and a trailing-edge wherein the first and second sides are in spaced-apart and generally parallel relation to each other, and are joined to each other at their respective leading edges;

a first pair of symmetrical guide members defined by the respective first and second sides of the rudder housing and located at upper portions of each respective side;

a pair of symmetrical hub holes defined by the first and second sides of the rudder housing for receiving a rudder shaft; and a push rod slidingly engageable with the first pair of symmetrical guide members.

2. The rudder assembly of claim 1 further comprising a second pair of symmetrical guide members defined by the respective first and second sides of the rudder housing and located generally between the lower leading edge portions of each respective, side and the hub holes, wherein a portion of the push rod is slidingly engageable therewith.

3. The rudder assembly of claim 2 wherein the first pair of symmetrical guide members comprise a pair of slots defined by the respective first and second sides and the second pair of symmetrical guide members comprise a pair of slots defined by the respective first and second sides.

4. The rudder assembly of claim 2 wherein the push rod has an upper end and a lower end, and further comprises an upper pin located at the upper end to engage the first pair of symmetrical guide members and a lower pin located at the lower end to engage the second pair of symmetrical guide members.

5. The rudder assembly of claim 1 wherein the first pair of symmetrical guide members comprise a pair of slots defined by the respective first and second sides.

6. The rudder assembly of claim 1 wherein the push rod has an upper end and a lower end, and further comprises an upper pin located at the upper end to engage the first pair of symmetrical guide members.

7. The rudder assembly of claim 1 further comprising a rudder blade having a notch formed in an upper portion thereof to receive a lower portion of the push rod.

8. The rudder assembly of claim 1 further comprising a removable tiller bracket attachable to an upper portion of the leading edges of the first and second sides.

9. The rudder assembly of claim 1 further comprising a rudder blade defining a hole, a biasing element linking the rudder blade to the rudder housing, and a hub having a rudder shaft for rotationally connecting the rudder blade to the rudder housing.

10. The rudder assembly of claim 9 wherein the rudder blade defines a cylindrical recess concentric about the rudder hole on a first side of the rudder blade and the biasing element is a torsion spring having one end attached to the rudder blade and another end linked to the rudder housing, the spring being locatable in the cylindrical recess.

11. The rudder assembly of claim 9 wherein the hub further comprises at least one registration pin and the second side of the rudder housing defines a plurality of registration holes disposed about the hub hole.

12. The rudder assembly of claim 9 wherein the rudder blade defines a recess at an outer leading edge peripheral portion thereof to receive a lower portion of the push rod whereby compressive actuation of the push rod causes rotation of the rudder blade about the rudder shaft.

13. A rudder for use in a watercraft comprising:

a blade having a leading edge and a trailing edge, and a first major side and a second major side;

a rudder shaft hole defined by the blade having an axis and extending from the first major side to the second major side;

a cylindrical recess defined by the first major side concentric about the rudder shaft hole; and a tang receiving hole defined by the rudder blade.

14. The rudder of claim 13 further comprising a torsion spring sized to fit within the cylindrical recess and having an outer tang for engaging the tang receiving hole.

15. The rudder of claim 13 wherein an upper portion of the rudder blade leading edge defines a notch.

16. A foot operated steering assembly for use in a watercraft having a forward end and an aft end that includes a rudder to thereby define an axis, the assembly comprising:

a first track segment;

a first foot brace slidingly engageable with the first track segment comprising a track portion;

a first toe control pivotally linked to the first foot brace whereby the toe control is pivotal about an axis substantially orthogonal to the forward-aft axis; and a first foot brace adjusting means for permitting a user to slidingly modify the location of the first foot brace in the first track segment.

17. The steering assembly of claim 16 wherein the first foot brace adjusting means comprises a rigid linear adjusting member connected to the first foot brace at one end and engageable with a portion of the first track segment to permit remote user location of the first foot brace in the first track segment.

18. The steering assembly of claim 17 wherein the rigid linear adjusting member comprises a plurality of land elements that are selectively engageable with a portion of the first track segment.

19. The steering assembly of claim 16 wherein the first foot brace adjusting means comprises an elastic-member connected to the first foot brace at one end and to a mechanical ground at another end, and a first flexible tension member extending from the foot brace to permit remote user location of the first foot brace in the first track segment.

20. The steering assembly of claim 16 further comprising a first rudder control cable having a first end and a second end wherein the first end is linkable to a rudder system and the second end is linkable to a mechanical ground wherein a portion of the cable contacts the first toe control and is deflectable thereby during operation of the steering assembly.

21. The steering assembly of claim 20 further comprising a first cable adjusting member operatively linking the second end of the cable to the mechanical ground whereby tension in the cable can be increased or decreased by the cable adjusting member if the first end of the first cable remains stationary.

22. The steering assembly of claim 20 further comprising a rudder trim adjustment assembly having a housing defining a volume and at least one cable hole, and a rotatable hub sized to fit within the housing volume and having a first cable retention hole defined thereby and means for permitting a user to selectively rotate the hub, wherein the second end of the first cable is locatable in the first cable retention hole defined by the hub and tension in the cable can be increased or decreased by the trim adjustment assembly by rotation of the hub if the first end of the first cable remains stationary.

23. The steering assembly of claim 16 further comprising an aft end cap defining a slot for receiving a portion of the first foot brace adjusting means whereby sliding movement of the first foot brace is selectively limited by a user.

24. The steering assembly of claim 16 further comprising a second track segment; a second foot brace slidingly engageable with the second track segment comprising a track portion; a second toe control pivotally linked to the second foot brace; and a foot brace adjusting means for permitting a user to slidingly modify the location of the second foot brace in the second track segment.

25. In a watercraft having a cable operated rudder system comprising a rudder linked to a mechanical ground; a first cable extending from the rudder to a rudder control assembly also linked to a mechanical ground; and a second cable extending from the rudder to the rudder control assembly, a rudder trim adjustment assembly mountable to a mechanical ground, comprising:

a housing defining a volume and at least one cable hole; and a hub sized to fit within the housing volume and having at least one cable retention hole defined thereby and means for permitting a user to selectively rotate the hub wherein at least the first cable engages the hub and the hub remains stationary during operation of the rudder system.

26. A foot operated steering assembly for use in a watercraft having a forward end and an aft end that includes a rudder, the assembly comprising:

a first track segment;

a first foot brace slidingly engageable with the first track segment comprising a track portion;

a first toe control pivotally linked to the first foot brace; and a first foot brace adjusting means extending towards the aft end of the watercraft for permitting a user to slidingly modify the location of the first foot brace in the first track segment.

* * * * *